US006561258B1

(12) United States Patent
Kumpula

(10) Patent No.: US 6,561,258 B1
(45) Date of Patent: May 13, 2003

(54) MOLD STEEL

(75) Inventor: Mikko Kumpula, Tampere (FI)

(73) Assignee: Metso Powdermet Oy, Tampere (FI)

( * ) Notice: Subject to any disclaimer, the term of this patent is extended or adjusted under 35 U.S.C. 154(b) by 0 days.

(21) Appl. No.: 09/857,351

(22) PCT Filed: Nov. 15, 1999

(86) PCT No.: PCT/FI99/00944

§ 371 (c)(1),
(2), (4) Date: Aug. 17, 2001

(87) PCT Pub. No.: WO00/32832

PCT Pub. Date: Jun. 8, 2000

(30) Foreign Application Priority Data

Dec. 2, 1998 (SE) ..... 982599

(51) Int. Cl.[7] ..... B22D 17/00; C22C 38/52
(52) U.S. Cl. ..... 164/113; 164/476; 164/61; 164/469; 420/95; 420/107; 148/335; 148/563
(58) Field of Search ..... 164/113, 476, 164/61, 469; 420/95, 107; 148/335, 563

(56) References Cited

U.S. PATENT DOCUMENTS 4,036,669 A * 7/1977 Brook et al. ..... 420/95
5,393,488 A * 2/1995 Rhoads et al. ..... 420/95
6,149,742 A * 11/2000 Carpenter et al. ..... 148/563

FOREIGN PATENT DOCUMENTS

| | | | |
|---|---|---|---|
| EP | 0 767 251 A1 | | 4/1997 |
| EP | 0767251 | * | 4/1997 |
| GB | 1 243 382 | | 8/1971 |

* cited by examiner

*Primary Examiner*—Tom Dunn
*Assistant Examiner*—I.-H. Lin
(74) *Attorney, Agent, or Firm*—Burns, Doane, Swecker & Mathis, L.L.P.

(57) ABSTRACT

A maraging steel for use as a mold steel is disclosed. In general, the use of maraging steels in molds is limited by the fact that the martensitic microstructure is not stable at temperatures above 480° C. The precipitate hardening maraging type steel according to the invention contains titanium, molybdenum, cobalt, chromium and nickel and has, in addition to high strength, good ductility, small thermal expansion coefficient and good thermal conductivity, a significantly better thermal stability than other maraging steels, which makes it suitable for use as a mold material particularly in pressure casting.

13 Claims, No Drawings

MOLD STEEL

BACKGROUND

1. Field of the Invention

The invention relates to the field of casting mold materials. Particularly, the invention relates to a steel useful in connection with pressurized casting and corresponding methods.

2. Background of the Invention

In the description of the background of the present invention that follows reference is made to certain structures and methods, however, such references should not necessarily be construed as an admission that these structures and methods qualify as prior art under the applicable statutory provisions. Applicants reserve the right to demonstrate that any of the referenced subject matter does not constitute prior art with regard to the present invention.

In pressure casting and comparable methods, stresses on the mold are caused by the cyclic thermal shock due to the contact between molten metal and the mold steel, hydrostatic pressure due to the injection pressure, as well as mechanical and chemical abrasion of the mold surface due to the flow of molten metal. Mechanisms of mold damage are thermal fatigue, macrocracking and so-called wash out occurring as a consequence of erosion, corrosion and welding phenomena. The dominant mechanism of damage is partly dependant on the cast metal, the size and shape of the mold and the mold material. The most common cause of damage is hot cracking, which is the cause of about 85% of damage cases.

Hot cracking is reticular cracking on the mold surface caused by thermal fatigue. Unlike ordinary fatigue, thermal fatigue is not due to fluctuating external stresses, but the cyclic tension and distortion resulting in cracking is caused by temperature variations. On the basis of theoretical studies, it can be concluded that from the point of view of hot cracking resistance, the yield strength of the mold material should be high and as independent as possible of temperature and number of cycles, i.e. the material should be thermally stable.

In addition to hot cracking, wash out is another main mechanism leading to mold damage. Wash out refers to the removal of material from the mold surface due to the interaction between molten metal and the mold material. It has been established that corrosive, erosive and welding mechanisms are involved, and that it occurs mainly at sites where the mold material interacts strongly with the molten metal, as in the feed region and in cores. For wash out resistance, the hardness of the mold material should be high and the mold material should not easily form compounds with the molten metal.

Additional desirable material properties for pressure mold steels are as follows:

- high yield strength
- good ductility
- good heat conductivity
- good hot erosion resistance
- small heat expansion coefficient
- small size, even distribution and stable structure of precipitates
- matrix stability
- small solubility of mold material alloying elements in the metal subject to pressure molding

- low level of impurities and good slag purity
- homogeneous structure

Generally, it can be said that the properties of a mold steel are determined by the composition and the method of preparation, as well as the hot working and annealing.

The use of conventional maraging steels as a mold material is limited by the fact that the martensitic microstructure is not stable at temperatures above 480° C. Above this temperature, the martensitic structure slowly begins to change into an austenitic structure. Austenite has different properties from those of martensite; the strength and thermal conductivity are lower, larger thermal expansion etc., and these deviating properties cause local tensions which accelerate the development of thermal cracks on the mold surface and thus shorten the service life of the mold.

The austenization temperature of Fe—Ni, Fe—Cr and Fe—Ni—Cr— based maraging steels is lowered particularly by nickel (about 10° C. per weight-%) and chromium, however notably less by the latter than by the former. On the other hand, nickel and chromium particularly enhance the ductility of maraging steels. The austenization temperature of maraging steel can thus be raised by lowering the nickel content and/or by replacing part of the nickel with chromium. Simultaneously, care must be taken that the other properties of the steel remain on the appropriate level, by means of other alloying components.

SUMMARY OF THE INVENTION

A precipitate hardened mold steel of the maraging type, containing titanium, cobalt, chromium and nickel, has been invented having, in addition to high strength, good ductility, small thermal expansion coefficient and good thermal conductivity, a significantly better thermal stability than other maraging steels, and thus a better resistance to thermal cracking and wash out than conventional maraging steels.

A maraging-type mold steel according to this invention, containing titanium, molybdenum, cobalt, chromium and nickel, is prepared by a method that allows minimal impurity content of solid elements like carbon, phosphorus, sulphur, silicon, manganese and copper, and of gaseous elements like oxygen, nitrogen and hydrogen. Preferably, vacuum induction melting (VIM) is used, complemented by vacuum re-melting (VAR).

A maraging type mold steel according to the invention contains, in weight percent, no more than 0.03, preferably no more than 0.02% carbon; 9–18, preferably 10–14% nickel,; 1–5, preferably 1–3% chromium; 2–8, preferably 2–5% molybdenum; 5–15, preferably 10–12% cobalt; and 0.1–1.5, preferably 0.2–0.7% titanium. Preferably, the ratio Ni/Ti is in the range 15–20.

Preferably, a steel according to the invention additionally contains, in weight percent, no more than 1.0, preferably no more than 0.2% aluminum; silicon and manganese together no more than 0.20%, preferably no more than 0.15%; sulphur no more than 0.010%, preferably no more than 0.003%; phosphorus no more than 0.010, preferably no more than 0.005; the residue being iron and possible impurities.

DETAILED DESCRIPTION

The invention is demonstrated below by means of an experimental series performed with different grades of steel. Several tests and laboratory assays have been made in order to allow a comparison of the value of the invention relative to conventional maraging steels in use today. A1 and A2 represent maraging steels presently in use, and B1, B10 and B13 represent steels according to the present invention. The compositions of the steels are shown in Table 1.

TABLE 1

| | Test materials | | | | |
|---|---|---|---|---|---|
| | Ni | Cr | Mo | Co | Ti |
| A1 | 14.1 | 0.026 | 4.72 | 10.9 | 0.19 |
| A2 | 19.3 | 0.035 | 4.62 | 7.3 | 0.44 |
| B1 | 9.6 | 4.12 | 1.02 | 9.7 | 0.74 |
| B10 | 12.1 | 3.28 | 2.52 | 10.5 | 1.04 |
| B13 | 12.2 | 3.12 | 4.51 | 10.6 | 0.65 |

As the onset temperature (As) for austenite formation was determined for the above experimental steels by means of the dilatometric method, as well as the onset temperature (Ms) for martensite formation and the end temperature, the following results were obtained:

TABLE 2

| | Onset temperature for reverse formation of austenite and onset and final temperatures for martensite | | | |
|---|---|---|---|---|
| | As, 1° C./s (° C.) | As, 10° C./s (° C.) | Ms (° C.) | Mf (° C.) |
| A1 | 701 | 723 | 357 | 251 |
| A2 | 644 | 684 | 189 | <80 |
| B1 | 710 | 730 | 360 | 230 |
| B10 | 706 | 723 | 353 | 221 |
| B13 | 705 | 714 | 285 | 153 |

As can be seen from the table, the temperature for austenite formation can be raised from the value of 644° C. for conventional maraging steel by lowering the nickel content and replacing part of the nickel with chromium. In the steel according to the application, the onset temperature for reverse austenite formation is above 700° C. measured by the dilatometric method, the rate of temperature change being 10° C./s.

For the experimental steels the following properties were determined:

1) strength properties at room temperature, and at
2) elevated temperatures,
3) precipitate behavior as a function of time,
4) fatigue both at room temperature and at
5) elevated temperature,
6) thermal expansion coefficients,
7) thermal conductivity,
8) resistance to thermal fatigue, by means of two methods.

The above mentioned mechanical and thermal properties were not determined for all the experimental grades shown in Table 1. The basic properties were determined for all, but certain tests were made e.g. only by comparison of two chemical compositions.

TABLE 3

| | Tensile strength and breaking elongation at room temperature and at elevated temperature | | | | | | |
|---|---|---|---|---|---|---|---|
| | Rm (Mpa) | 21° C. A5(%) | E (Gpa) | 400° C. Rm (Mpa) | A5 (%) | 600° C. Rm (Mpa) | A5(%) |
| A1 | 1669 | 10 | 194 | 1396 | 9 | 786 | 15 |
| A2 | 1745 | 7 | 180 | 1419 | 6 | 786 | 19 |

TABLE 3-continued

| | Tensile strength and breaking elongation at room temperature and at elevated temperature | | | | | | |
|---|---|---|---|---|---|---|---|
| | Rm (Mpa) | 21° C. A5(%) | E (Gpa) | 400° C. Rm (Mpa) | A5 (%) | 600° C. Rm (Mpa) | A5(%) |
| B1 | 1532 | 10 | 195 | 1195 | 9 | 784 | 14 |
| B10 | 1799 | 8 | 194 | 1436 | 10 | 775 | 17 |
| B13 | 1962 | 7 | 197 | 1541 | 10 | 811 | 17 |

TABLE 4

| | Change in hardness at precipitation temperature 530° C./525° C. against time. | | |
|---|---|---|---|
| | Hardness, Vickers HV10 | | |
| | 6 hours | 9 hours | 15 hours |
| A1/525° C. | 543 | 537 | 525 |
| B10/530° C. | 568 | 570 | 558 |
| B13/530° C. | 603 | 600 | 581 |

TABLE 5

| | Tensile strengths, service life at ±900 MPa load and mean fatigue resistance related to tensile strength for test steels (comparative test) | | |
|---|---|---|---|
| | Rm (Mpa) | Service life ±900 Mpa No. of Cycles | Relative service life No. of cycles |
| B10 | 1799 | 23749 | 11875 |
| B13 | 1962 | 43510 | 20015 |

TABLE 6

| | Fatigue resistance at 400° C. (comparative test) | |
|---|---|---|
| | No. of Cycles | |
| | ±550 Mpa | ±750 Mpa |
| A1 | 729041 | 28515 |
| B13 | 757450 | 50477 |

TABLE 7

| | Thermal expansion coefficients of test steels | |
|---|---|---|
| | Thermal expansion coefficient $10^{-6}$/° C. | Temperature range ° C. |
| A1 | 10.8 | 20–600 |
| B10 | 11.9 | 20–710 |
| B13 | 11.3 | 20–710 |

TABLE 8

Thermal conductivity of test steels

| ° C. | Thermal conductivity W/cmK° A1 | B10 | B13 |
|---|---|---|---|
| 23 | 25.5 | 17.0 | 17.8 |
| 100 | 26.9 | 19.1 | 20.4 |
| 200 | 28.2 | 22.0 | 22.3 |
| 300 | 30.0 | 24.1 | 24.7 |
| 400 | 31.6 | 25.2 | 26.2 |
| 500 | 33.2 | 28.1 | 29.0 |
| 600 | 33.5 | 23.8 | 26.8 |
| 650 | | 21.7 | 23.3 |

The resistance to thermal fatigue was measured for the test steels using two different methods, the so-called Dunk wetting test and an inductive method.

In the wetting test, the test rods were of the size 12.7×12.7×152 mm, and a threaded hole was machined at one end for fixation. Prior to the test, the rods were kept in an oven at 371° C. for 1 hour. Thus, on the rod surface was formed an oxide layer, whose purpose was to reduce the sticking of aluminum to the rod surfaces during testing. During the test cycle, the piece was submerged into molten aluminum and held there for 3.5 seconds. After 15 000 cycles, the holding time was extended to 7 seconds. After the aluminum wetting, the piece was transferred to a mixture of water and pressure mold lubricant (LaFrance Franlube 3600) and held for 10 seconds. Before the next wetting, the piece was allowed to dry for about 5 seconds. A 384 grade aluminum was used in the test.

With intervals of 5000 wetting cycles, hardness and crack count were determined. For crack count, two opposite sides of the test piece were ground with 240 and 600 grid abrasive paper, and evaluated with a stereo microscope (magnification 90×) at four edges, on 35 mm regions located 35 mm from the lower end of the test piece. 25 000 wetting cycles were carried out on each test

TABLE 9

Results of Dunk wetting tests

| | No. of cycles/Hardness HRC 5000 | 10000 | 15000 | 20000 | 25000 | No. of cracks after 25000 cycles |
|---|---|---|---|---|---|---|
| A1 | 49 | 49 | 49 | 42 | 42 | 617 |
| B10 | 52 | 52 | 52 | 46 | 44 | 20 |
| B13 | 54 | 54 | 54 | 48 | 47 | 75 |

The thermal fatigue tests using an induction heating device were carried out as follows: The test piece was a ø 20×40 mm cylinder provided with a ø 4 mm axial bore. The piece was heated using an induction coil to a temperature of 600° C., whereupon it was cooled to room temperature using a water jet. The heating time during the test was 6 seconds, and cooling time 13 seconds. The test pieces were inspected after 10, 100, 500, 1000, 2500, 5000 and 10 000 cycles by making surface replicas and photographing these with a light microscope using a digital method. In addition, electron micrographs of the test pieces were made after 10 000 cycles.

TABLE 10

Results of thermal fatigue resistance tests by inductive method

| No. of cycles | Microscopic observations A1 | B13 |
|---|---|---|
| 0–1000 | no cracking | no cracking |
| 2500 | no cracking | no cracking |
| 5000 | initial cracking | no cracking |
| 10000 | cracking | some cracking |

The tests show, that the resistance to thermal fatigue is significantly higher in a steel according to the invention than in conventional maraging steels, and that this is due to the better thermal stability of the steel according to the invention at temperatures required for casting of light metals (Zn, Mg, Al). By carefully balancing the composition, also other properties influencing the service life of a pressure mold have been kept at a good level. It is important to keep the nickel/titanium rate small enough, that is below 20. Thus, titanium binds nickel into stable compounds between the metals, the matrix nickel content stays low enough, and the austenite reversion temperature is high enough.

The manufacture of a maraging-type mold steel according to the invention may comprise at least the following stages:

in a first stage, the starting materials are molten in an induction oven and cast in a vacuum, in a second stage, the cast billet is remelted in vacuum to homogenize the structure and further eliminate impurities, in a third stage, the remelted billet is hot worked using a reduction ratio of at least 1:3, and the worked billet is annealed.

As follows from the disclosure of prior art, a preferable field of use for the steel according to the invention is as a mold material for pressure casting of light metal alloys. In addition it may well be used for, e.g. making injection molds for plastic items.

While the present invention has been described by reference to the above-mentioned embodiments, certain modifications and variations will be evident to those of ordinary skill in the art. Therefore, the present invention is to limited only by the scope and spirit of the appended claims.

What is claimed is:

1. A precipitation hardening maraging steel, comprising in weight percent:

| | |
|---|---|
| Ni | 9–18; |
| Cr | 1–5; |
| Mo | 1–8; |
| Co | 5–15; |
| Ti | 0.1–1.5; |
| Al | Max. 1; |
| C | max. 0.03; and |

the balance being iron and residual impurities, wherein the steel comprises an onset temperature for reverse austenite formation of over 700° C. measured by the dilatometric method with a temperature rise of 10° C./s.

2. The steel according to claim 1, further comprising a combined content of silicon and magnesium of no more than 0.2 percent by weight.

3. The steel according to claim 2, further comprising a combined content of silicon and magnesium of no more than 0.15 percent by weight.

4. The steel according to claim 1, further comprising a sulfur content of no more than 0.010 percent by weight.

5. The steel according to claim 4, further comprising a sulfur content of no more than 0.003 percent by weight.

6. The steel according to claim 1, further comprising a phosphorous content of no more than 0.010 percent by weight.

7. The steel according to claim 6, further comprising a phosphorus content of no more than 0.005 percent by weight.

8. The steel according to claim 1, further comprising a ratio of nickel content to titanium content of less than 25.

9. The steel according to claim 8, further comprising a ratio of nickel content to titanium content of less than 20.

10. A mold for light metal alloy pressure casting comprising the steel of claim 1.

11. A precipitation hardening maraging steel, comprising in weight percent:

| | |
|---|---|
| Ni | 10–14; |
| Cr | 1–3; |
| Mo | 2–5; |
| Co | 10–12; |
| Ti | 0.2–0.7; |
| Al | max. 0.2; |
| C | max. 0.02; and |

the balance being iron and residual impurities, and having an onset temperature for reverse austenite formation of over 700° C. measured by the dilatometric method with a temperature rise of 10° C./s, the method comprising the steps of:

(a) melting in a vacuum induction oven and casting in vacuum;

(b) remelting of the cast billet for structural homogenization and elimination of impurities;

(c) hot working of the remelted billet with a reduction ratio of at least 1:3; and (d) annealing of the worked billet.

12. A method of preparing a precipitation hardening maraging steel having a composition in weight percent comprising

| | |
|---|---|
| Ni | 9–18; |
| Cr | 1–5; |
| Mo | 1–8; |
| Co | 5–15; |
| Ti | 0.1–1.5; |
| Al | Max. 1; |
| C | max. 0.03; and |

the balance being iron and residual impurities, and having an onset temperature for reverse austenite formation of over 700° C. measured by the dilatometric method with a temperature rise of 10° C./s, the method comprising the steps of:

(a) melting in a vacuum induction oven and casting in vacuum;

(b) remelting of the cast billet for structural homogenization and elimination of impurities;

(c) hot working of the remelted billet with a reduction ratio of at least 1:3; and (d) annealing of the worked billet.

13. A method of preparing a precipitation hardening maraging steel having a composition in weight percent comprising:

| | |
|---|---|
| Ni | 10–14; |
| Cr | 1–3; |
| Mo | 2–5; |
| Co | 10–12; |
| Ti | 0.2–0.7; |
| Al | Max. 0.2; |
| C | max. 0.02; and |

the balance being iron and residual impurities, and having an onset temperature for reverse austenite formation of over 700° C. measured by the dilatometric method with a temperature rise of 10° C./s, the method comprising the steps of:

(a) melting in a vacuum induction oven and casting in vacuum;

(b) remelting of the cast billet for structural homogenization and elimination of impurities;

(c) hot working of the remelted billet with a reduction ratio of at least 1:3; and (d) annealing of the worked billet.

* * * * *